US005692633A

United States Patent [19]

Gordon

[11] Patent Number: 5,692,633

[45] Date of Patent: Dec. 2, 1997

[54] BEVERAGE CONTAINER LID

[75] Inventor: Herman Gordon, Huntingdon Valley, Pa.

[73] Assignee: Hullko Corporation, Wyomissing, Pa.

[21] Appl. No.: 581,949

[22] Filed: Jan. 2, 1996

[51] Int. Cl.[6] ..... B65D 51/18

[52] U.S. Cl. ..... 220/253; 220/258; 220/268; 220/906

[58] Field of Search ..... 220/253, 258, 220/268, 277, 278, 906

[56] References Cited

U.S. PATENT DOCUMENTS

| | | | |
|---|---|---|---|
| 2,131,774 | 10/1938 | Waring . | |
| 3,726,432 | 4/1973 | Gentile . | |
| 4,077,538 | 3/1978 | Waterbury | 220/268 |
| 4,125,203 | 11/1978 | Sovari et al. . | |
| 4,345,696 | 8/1982 | Guimarin | 220/277 |
| 4,598,837 | 7/1986 | Kreiseder et al. . | |
| 4,706,835 | 11/1987 | Kreiseder . | |
| 4,930,654 | 6/1990 | Thibeault et al. . | |
| 5,090,582 | 2/1992 | Art et al. . | |
| 5,199,591 | 4/1993 | Thiebeault et al. . | |
| 5,205,430 | 4/1993 | Valyi . | |
| 5,269,432 | 12/1993 | Beckertgis | 220/253 |
| 5,421,472 | 6/1995 | Beckertgis | 220/253 |

*Primary Examiner*—Stephen Cronin
*Attorney, Agent, or Firm*—Synnestvedt & Lechner

[57] ABSTRACT

A container which has a top with two concentrically mounted lids, a first lid attached to and sealing the container and a second lid rotatably mounted to the first lid. The first lid has a weakened surface region formed by scoring, scribing or grooving. The first and second lids have nested embossments which are interengageable to apply a predetermined pressure to fracture the weakened region and form a pour aperture in the first lid when the second lid is rotated relative to the first lid. The second lid also has an aperture which is brought into an overlying relationship with the aperture in the first lid when the second lid is rotated relative to the first lid, thus allowing the contents of the container to be dispensed.

42 Claims, 4 Drawing Sheets

FIG. 1
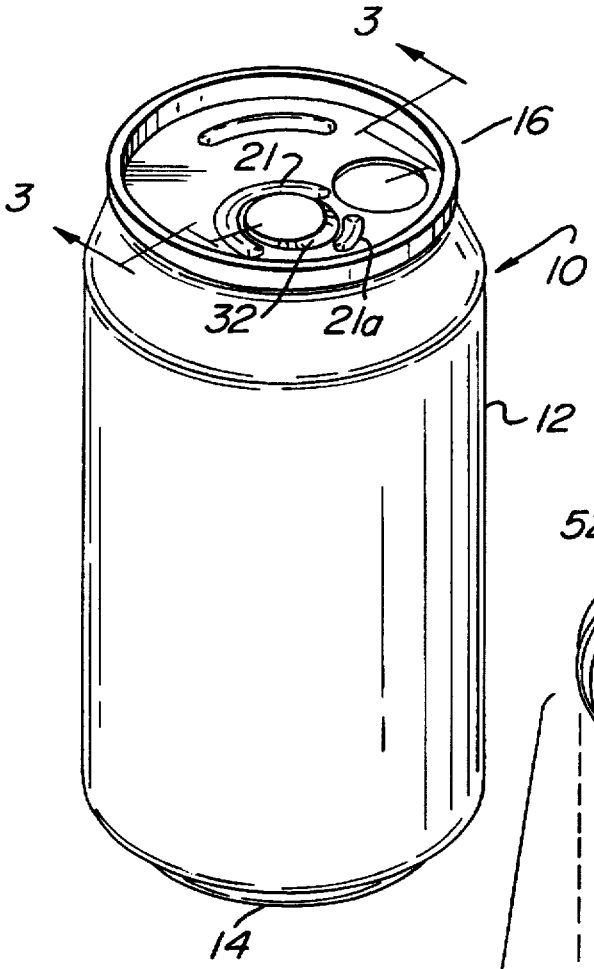
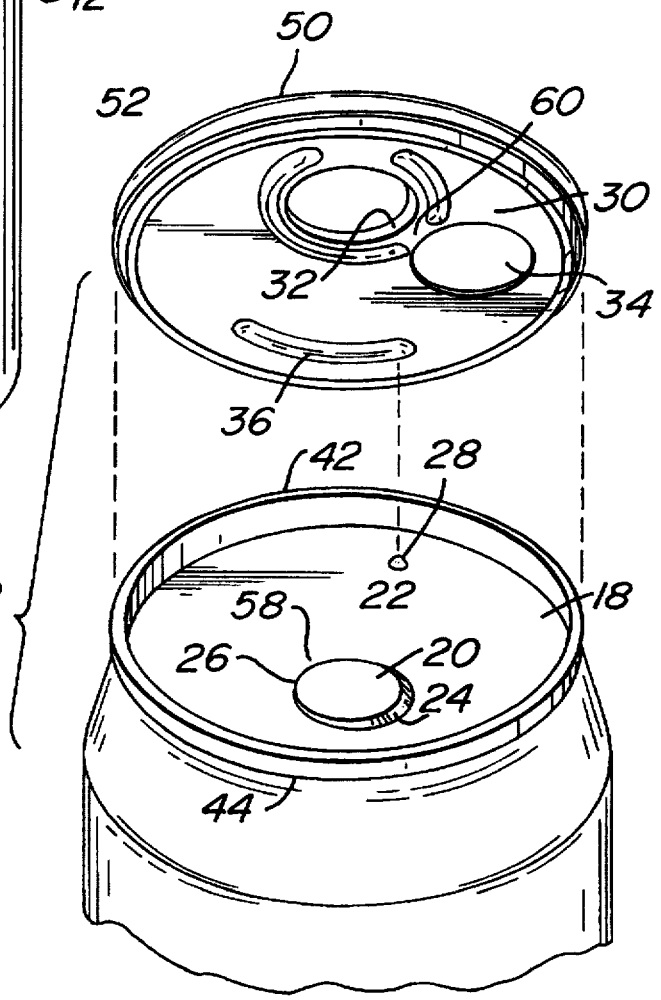
FIG. 2

BEVERAGE CONTAINER LID

FIELD OF THE INVENTION

This invention relates to containers, and especially to beverage cans with easy-open and reseal features.

BACKGROUND OF THE INVENTION

Sealed containers with easy-open features are used extensively to market various products such as beverages or other liquids, as well as solids in granular form. A typical example of such a container is provided by an aluminum beverage can. This container provides an air-tight seal for storing carbonated beverages and can be opened relatively easily without the use of a separate tool, such as a can opener. The top of the container has an integral, roughly oval tab defined by a score line cut in the top and a ring attached to the tab. The tab and ring work in conjunction such that lifting the ring exerts a prying force on the tab which fractures at the score line. The tab separates from the top along the score line and is forced downwardly into the container forming a pour opening for dispensing the contents of the container. The tab and ring combination desirably remain attached to the container.

There are several disadvantages to the ring-tab container design. Once opened, the ring tab cannot be used to close the aperture in the container. Unless consumed promptly, carbonated beverages rapidly lose carbonation, and if left untended, the further problem of inadvertent spillage exists. Still another problem is that people troubled by physical problems, such as arthritis, frequently find it difficult to grasp the ring to apply the force and to exert sufficient prying action to fracture the tab score line. This problem is sufficiently great that a special can opener has been marketed for use with ring-tab cans, which gives the user added leverage when opening the sealed tab. The need for a special tool entirely defeats the object of the tab-ring design. Sometimes the ring breaks free from the tab without opening the container. Perhaps the objectionable feature for many consumers is that the entire surface of the top is subject to exposure to dirt and other contaminants. These contaminants are introduced directly into the container contents by the action of the tab-ring design because the tab is forced into the container when the container is opened.

SUMMARY AND OBJECTS OF THE INVENTION

This invention provides a container for beverages or the like having a top comprising a pair of lids which are stacked and relatively movable to effect opening and closure.

The container has a first or inner lid which is attached to the sidewalls by means similar to those utilized with present containers. The first lid is substantially planar with an eccentrically disposed, raised surface portion or embossment, referred to as an emboss by those in the art. The raised surface portion is substantially surrounded by a narrow weakened region formed by scoring or scribing or the like. The residual left following scoring is strong enough to withstand the internal pressures likely to be encountered with the particular beverage the container is intended to hold but will fracture to form a pour opening upon application of a predetermined downward external pressure, as will be explained hereinafter. The weakened region is preferably surrounded by a first sealing surface portion.

A second lid is rotatably attached to the container on the outside of the first lid. The second lid has an aperture or pour opening and an emboss which nests over the emboss of the first lid and having a sloping wall portion which is in mating relationship with a sloping wall portion of the emboss on the first lid. The second lid preferably has a reinforcing rib surrounding its emboss and a sealing surface portion which extends around the emboss on the first lid and interfaces with the first sealing surface.

Upon rotation of the second lid relative to the first lid, the sloping surface of the emboss on the second lid cams the sloping surface of the emboss on the first lid to effect a fracture at the score line. Further rotation of the second lid relative to the first lid forces the raised surface portion downwardly into the container, forming the pour aperture in the first lid. The rotation of the second lid relative to the first lid also brings the apertures in the first and second lids into an overlying relationship, allowing the container contents to be dispensed.

In a preferred embodiment of the invention, the container pour aperture can be reclosed upon reversing the rotation of the second lid relative to the first lid so that the pour aperture is covered by the lid stock of the first lid. Desirably, the surface portions on each lid which are brought into overlying relationship by the relative rotation effect a seal which protects the contents and prolongs the carbonation, as well as to eliminate any risk of significant spillage if the opened container is left untended.

It is an object of the invention to provide a sealed container having a novel and improved self-contained means for opening the container, not relying in any way on the use of a ring tab or of an extrinsic tool to effect opening of the container. It is a further object of the invention to provide a container which is easy to open. A further object of the invention is to provide a container in which the easy-open feature works reliably. It is also an object to provide a container which is easy to reclose. Another object of the invention is to provide a container in which the pour aperture is protected against dirt and contamination. A more specific object of the invention is to provide a container in which the portion of the lid stock which forms the closure for the pour aperture is initially covered so that the container contents are protected from contamination when the container is opened. Other objects and advantages of the invention include the provision of a novel end closure of a container for beverages or the like which reduces risk of can end burst, which is economical to the manufacture, allows for a reduction in can end area, is easily opened and reduces the risk of injury to the consumer. These and other objects will become apparent from a consideration of the following drawings and detailed description.

BRIEF DESCRIPTION OF THE DRAWINGS

In the detailed description of a preferred embodiment of the invention, reference is made to the following drawings in which:

FIG. 1 is an isometric view of a container according to the invention;

FIG. 2 is an isometric and exploded view of the upper portion of the container of FIG. 1 viewing the first lid from above and the second lid from below;

DETAILED DESCRIPTION OF THE PREFERRED EMBODIMENT

Figure 3:
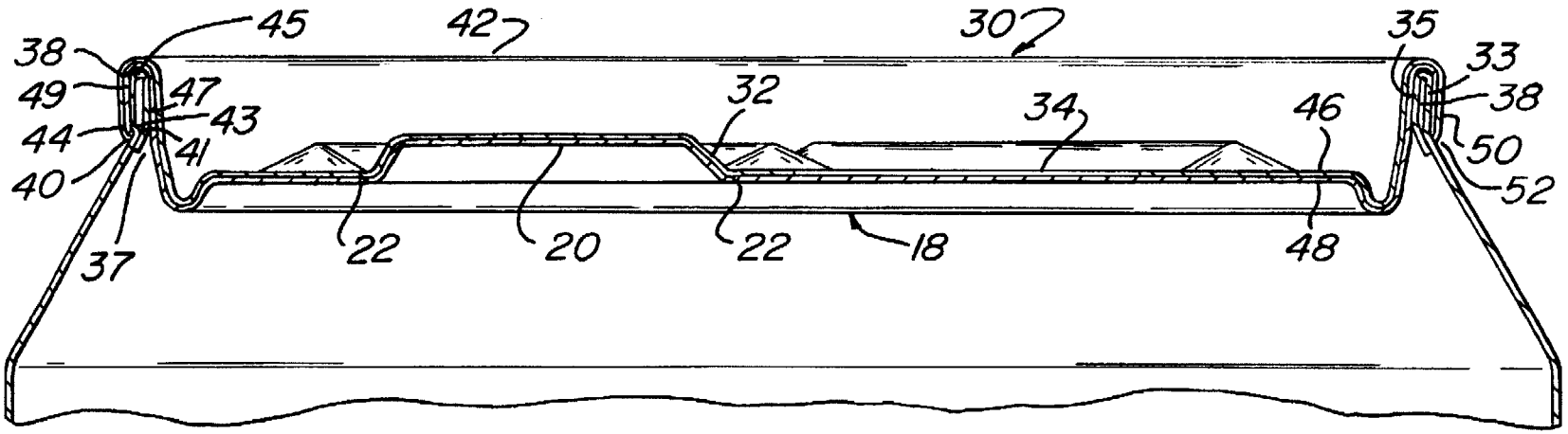
FIG. 3 is a sectional view of the container sidewall and top taken on line 3—3 of FIG. 1 showing the top with first and second lids in the initial sealed configuration.

FIG. 1 shows a container 10 for carbonated beverage constructed according to the invention. The body of container 10 is of conventional construction, typically being of cylindrical shape and made of a material such as an aluminum alloy. Such a container 10 has a cylindrical sidewall 12, a bottom 14 formed as a unit with the sidewall and a separate top or end closure 16 which is applied and fixed in place as a part of the container filling process. As shown in FIGS. 3–6, container 10 typically formed with a reinforced circular rim 38, shown in FIGS. 3–6, surrounding the circular opening 37. Rim 38 is formed by folding the free edge of the container sidewall 12 through 180° inwardly against itself around the entire circumference of circular opening 37, thus forming an extended inner rim wall 35 and an extended outer rim wall 33. An annular indentation 40 is located adjacent to rim 38, indentation 40 being preferably formed by the sidewall 12 curving inwardly to a smaller cylinder diameter 41 and outwardly to a larger cylinder diameter 43 for reasons which will be explained below.

In carrying out the invention, container end closure or top 16 is comprised of a first lid 18 and a second lid 30, both shown in FIG. 2 which is an exploded view of the upper portion of the container. The first and second lids are preferably substantially planar and circular and formed in forming dies from aluminum alloy stock typically having a thickness of about 0.009 inches. First lid 18 has a first lid flange 42, preferably continuous and disposed around its circumference which fits over rim 38, as shown in FIGS. 2 and also in section in FIGS. 3–6. First lid 18 also has a first lid circumferential edge 44, preferably continuous, forming the outermost edge of first lid flange 42.

First lid 18 is joined to sidewall 12 at circular opening 37, using known techniques, by bending first lid flange 42 so that it is press fitted over rim 38. Preferably, the circumferential edge 44 is bent inwardly such that it fits under annular indentation 40, shown in FIGS. 3–6.

Second lid 30, concentrically disposed on first lid 18, has a circumferentially extending lid flange 50 which fits over flange 42 of the first lid and is relatively rotatable with respect thereto. A circumferential edge 52 on second lid 30 is bent inwardly to rest within the annular indentation 40. The inwardly bent flange edge bears against the circumferential edge 44 so as to serve as a retainer for the first lid.

First lid 18 further has a raised portion or emboss 20, eccentrically located, preferably circular and with sloping sidewalls substantially surrounded by a relatively narrow weakened region or score line 22 typically formed by scoring, scribing or stamping. Score line 22 is designed to fracture and form a first lid aperture 54, shown in FIGS. 4–6, when a predetermined pressure is applied to the raised portion or emboss 20.

Figure 4:
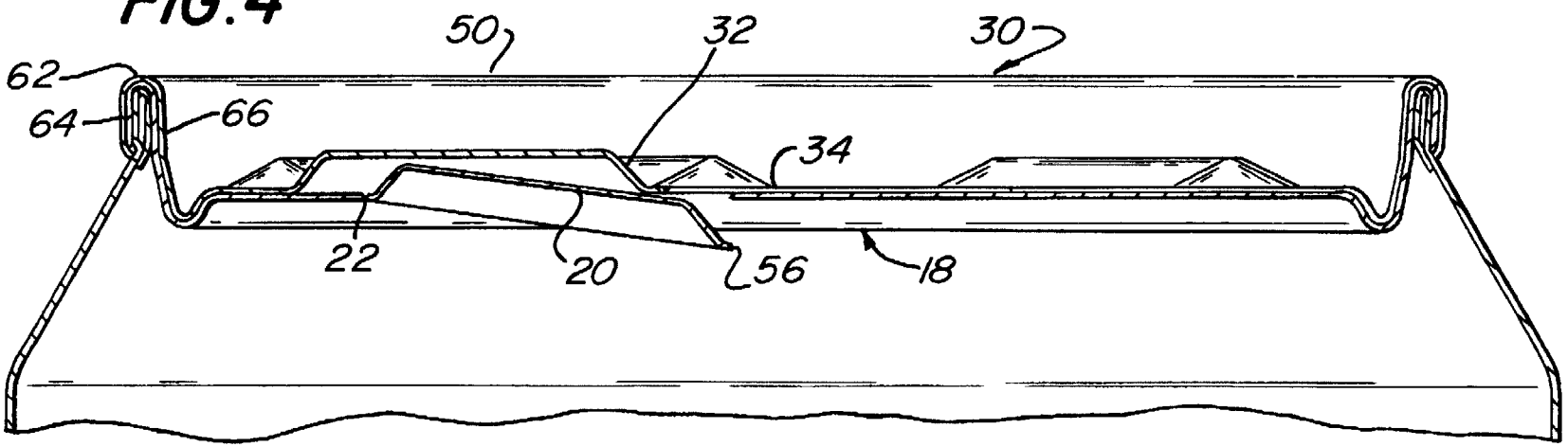
FIG. 4 is a sectional view of the container side wall and top taken on line 3—3 of FIG. 1 showing the second lid partially rotated relative to the first lid.

Second lid 30 preferably is provided with a second emboss or raised surface portion 31, eccentrically located, so that in an initial position, it snuggly nests over first emboss 20, as can be seen best in FIGS. 3–6. Reinforcing ribs 21 and 21*a* surround emboss 22 to serve as stiffeners for the lid stock in the region of the emboss. When the second lid 30 is rotated relative to the first lid 18, preferably clockwise, a sloped sidewall 32 on emboss 31 contacts the sloped sidewall of emboss 20, applying the predetermined camming pressure to cause score line 22 to fracture, as shown at 56 in FIG. 4. As seen in FIG. 4, the raised surface emboss 20 is forced downwardly into container 10 as the second lid 30 is rotated relative to the first lid 18.

Score line 22 preferably has a relatively deep region 24 at the point where surface portion 32 initially contacts surface portion 20 so that it initially fractures at this point and a relatively shallow portion 26 diametrically opposite the relatively deep region. The relatively deep portion 24 facilitates fracture initiation while the relatively shallow portion 26 serves as a hinge means which remains attached to the first lid 18 as the raised surface portion 20 is further forced downwardly by surface portion 32 as second lid 30 is further rotated relative to the first lid 18, as can be clearly seen in FIGS. 4 and 5. In carrying out the invention, in 0.009 inches lid stock, a residual of about 0.002 inches at the deepest point of the score line and about 0.003 at the shallow region has been found to be satisfactory.

Figure 5:
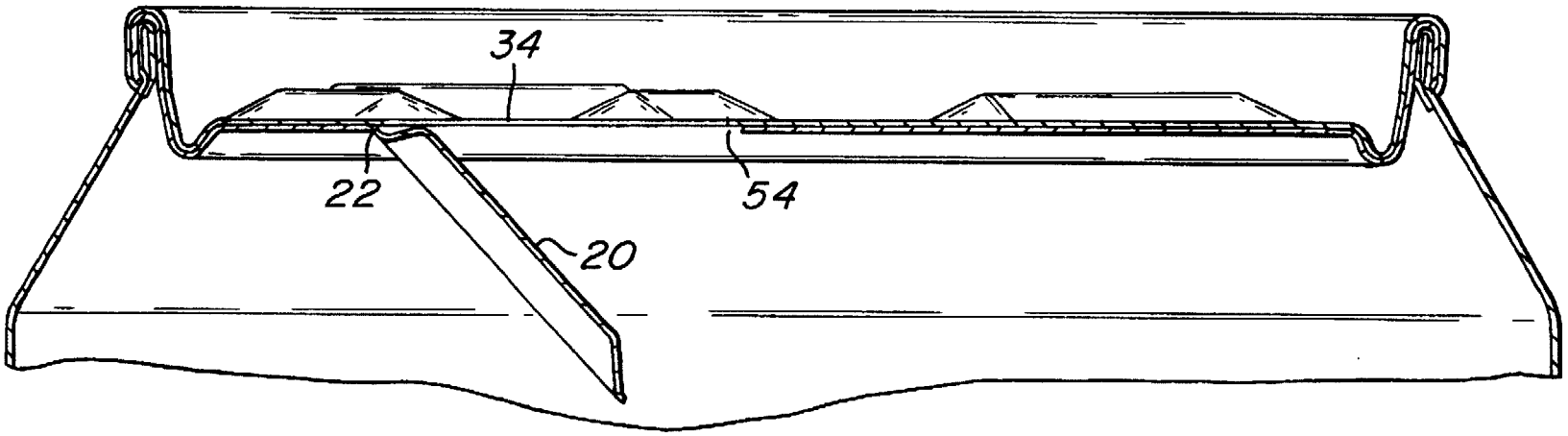
FIG. 5 is a sectional view of the container sidewall and top taken on line 3—3 of FIG. 1 showing the full rotation of second lid relative to the first lid to bring the apertures in both lids into registry.

A predetermined angle of rotation of the second lid 30 relative to the first lid 18 causes a first lid pour aperture 54 to be fully formed by fracture along score line 22 and preferably brings second lid aperture 34 into registry with the first lid aperture 54, shown in FIG. 5. Preferably, the first and second lids have cooperative means to limit the angular rotation of the second lid 30 relative to the first lid 18. The first lid has a protrusion in the form of a dimple 28 eccentrically positioned substantially diametrically opposite to the raised portion 20. The second lid has a guide recess, preferably in the form of an arcuate groove 36, eccentrically positioned on the second lid. Dimple 28 slidably fits within groove 36. Groove 36 is so positioned and dimensioned relative to dimple 28, surface portion 32 and second lid aperture 34 so that the dimple 28 is at the end of groove 36 when the second lid 30 is rotated through the predetermined angle of rotation relative to the first lid 18. As a result of the motion, the surface portion 32 cams emboss 20 downwardly initiating fracture of score line 22 at its relatively deep region 24, then forcing emboss 20 downwardly into container 10 forming the first lid pour aperture 54. The rotation of the second lid to the extreme limit permitted by groove 36 finally brings the second lid aperture 34 into registry with the first lid aperture 54.

Figure 5A:
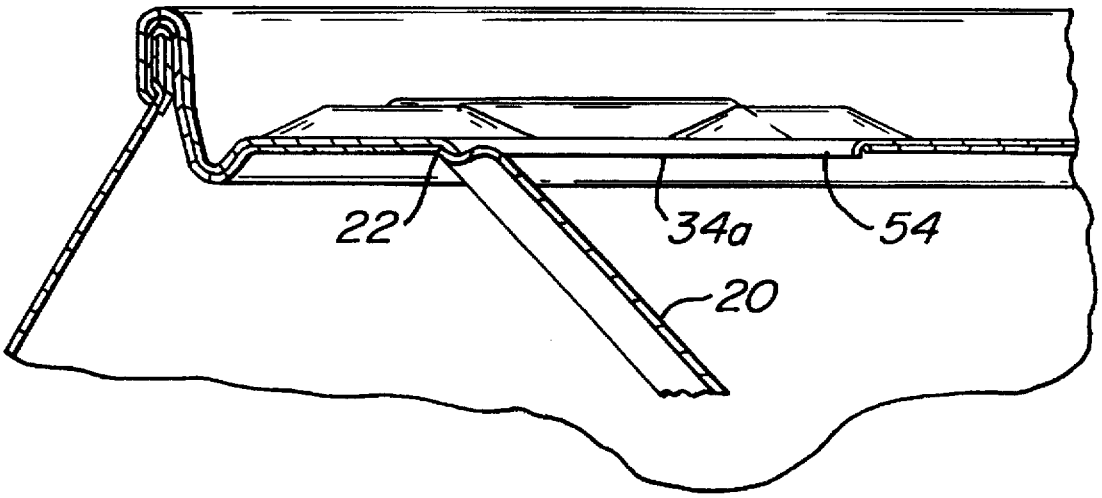
FIG. 5*a* is a sectional view similar to FIG. 5 showing a modification to the aperture in the second lid.

As a means of eliminating the risk of cuts sometimes occurring with the apertures in the lids of conventional tab opening cans, the edges of aperture 34 may be extended inwardly to form a downturned guard lip, shown at 34*a* in FIG. 5*a*. When the two apertures are in registry, as illustrated in the modification of FIG. 5*a*, the lip 34*a* fits over the edges of aperture 54.

Figure 6:
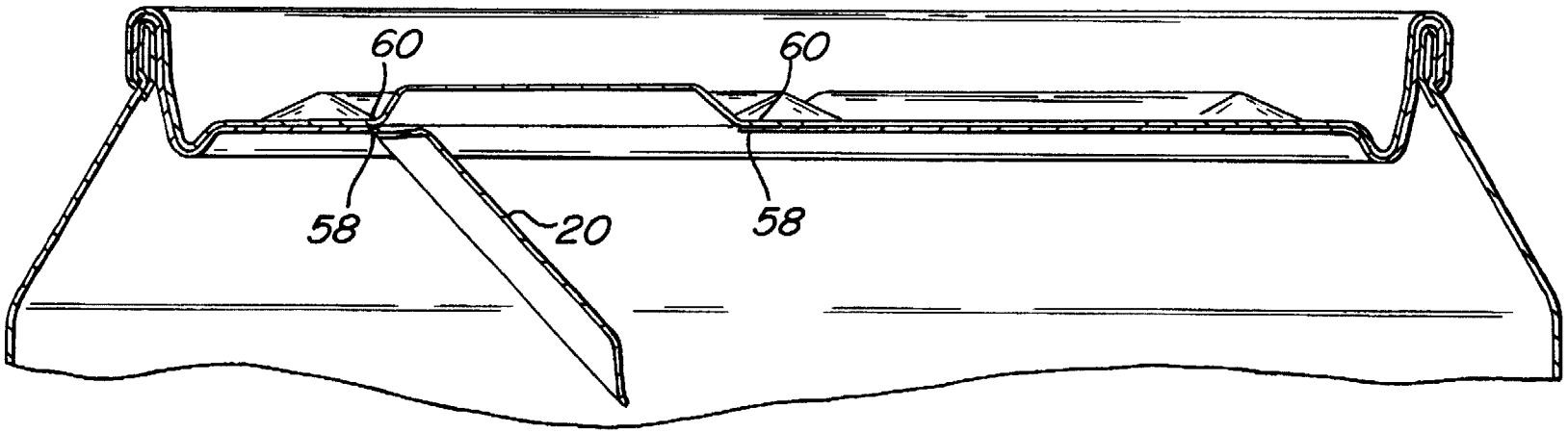
FIG. 6 is a sectional view of the container sidewall and top taken on line 3—3 of FIG. 1 showing the second lid relatively rotated back to the first position in order to effect reclosure of the dispensing aperture.

The first and second lids further cooperate to seal container 10 after opening. A first lid sealing surface portion 58 immediately surrounds score line 22 and cooperates with second lid sealing surface 60 disposed adjacent to second lid aperture 34. When the second lid 30 is rotated from the position where the second lid aperture 34 is in registry with the first lid aperture 54 to the position where the second lid aperture 34 is not overlapping the first lid aperture 54, the second lid sealing surface portion 60 interfaces with the first lid sealing surface portion 58, as shown in FIG. 6. Substantially the same predetermined relative angular rotation required to bring the lid apertures into registry is required to bring the surface sealing portions into registry. This relative angular rotation is opposite in direction to the rotation which brings the lid apertures into registry. The relative angular rotation is preferably limited in both instances by the protrusion 28 traversing the groove 36.

In summary, the invention offer significant advantages over present tab opening can designs.

The two embosses nested one within the other effectively protect the aperture forming area of first lid from contaminants and from damage, reducing the risk of can end burst. The nested embosses contribute to facilitate easy fracture at the score line due to the camming action of the sloping sidewalls of the nested embosses. The twist-open lid is appreciably easier to open by those with arthritis and other joint diseases. Elimination of the need for a pull tab as used on conventional beverage cans eliminates a constant tooling maintenance problem, reduces production costs and avoids the troublesome problems of tab breakage. Carbonation of beverages in opened cans can be prolonged due to the ability to close the pour aperture. The diameter of the can end may be reduced as compared to conventional tab opening cans without appreciably affecting the ease with which the can is able to be opened, thereby further increasing resistance to can end burst.

I claim:

1. A container comprising side walls, a bottom and a top, said top comprising a first lid joined to the side walls, said first lid comprising a single layer of homogeneous composition sealing said container, said first lid Being substantially planar and having a raised surface portion eccentrically disposed thereon, a weakened region surrounding said raised surface portion and a second lid, said second lid being substantially planar and being rotatably mounted on the top of the first lid for relative motion with respect to said first lid, means on said second lid interengageable with said raised surface portion on the first lid and being positioned to interengage and fracture said weakened region to form an aperture in said first lid defined by said weakened region upon rotation of the second lid relative to the first, said second lid having an aperture being positioned to move into overlying relationship with the aperture in the first lid upon further rotation of the second lid relative to the first.

2. A container according to claim 1, wherein the raised surface portion is sealed by said second lid when the aperture in the second lid is displaced from said weakened region.

3. A container according to claim 1, wherein said top is circular.

4. A container according to claim 3, wherein said second lid is concentrically mounted relative to said first lid.

5. A container according to claim 3, wherein said interengageable means on said second lid comprises an embossment, said raised surface portion of said first lid being nested within said embossment.

6. A container according to claim 5, further including means for limiting the rotation of the second lid relative to the first lid, said rotation limiting means permitting relative rotation between a first position in which said apertures are displaced from each other and a second position in which said apertures are in registry.

7. A container according to claim 6, wherein second lid includes sealing means for establishing a seal around the weakened region in the first lid when the lids are relatively rotated to the first position.

8. A container according to claim 7, wherein said rotation limiting means comprises a protrusion on one of said lids and a guide recess on the other of said lids, the protrusion interfitting within said guide recess, the apertures being in registry when the protrusion is at one end of the recess and being displaced when at the opposite end of the guide recess.

9. A container according to claim 8, wherein said guide recess is an arcuate groove.

10. A container according to claim 9, wherein said protrusion is on said first lid and said recess is on said second lid.

11. A container according to claim 10, wherein said rotation limiting means comprises a protrusion in one of said lids and a guide recess on the other of said lids, the protrusion interfitting within said guide recess, the apertures being in registry when the protrusion is at one end of the recess and the sealing surfaces being in registry when the protrusion is at the opposite end of the guide recess.

12. A container according to claim 11, wherein said guide recess is an arcuate groove.

13. A container according to claim 12, wherein said protrusion is on said first lid and said groove is on said second lid.

14. A container according to claim 7, wherein said sealing means comprises a sealing surface portion immediately surrounding the weakened region of said first lid, said sealing surface portions being in sealing contact when the lids are relatively rotated to the first position.

15. A top for use with a container for beverages said top comprising a first lid, said first lid having a substantially planar upper surface of a relatively thin metal and having a first raised surface portion eccentrically disposed thereon, a narrow fracture zone surrounding said raised surface portion and a second lid, said second lid being substantially planar and being rotatably mounted on the top of the first lid for relative motion with respect to said first lid, said second lid having a second raised surface portion and an aperture adjacent thereto, said first raised surface portion being nested within said second raised surface portion, the raised surface portions having walls positioned to interengage and fracture said fracture zone to form a pour aperture in said first lid defined by said fracture zone upon rotation of the second lid relative to the first, said aperture in said second lid being positioned to overlie with the aperture in the first lid upon further rotation of the second lid relative to the first.

16. A top according to claim 15, wherein said top is circular.

17. A top according to claim 16, wherein said second lid is concentrically mounted to said first lid.

18. A top according to claim 15, further including means for limiting the rotation of the second lid relative to the first lid, said rotation limiting means permitting relative rotation between a first position in which said apertures are out of overlapping relationship, whereby said aperture in said first lid is covered and a second position in which said apertures are in registry.

19. A top according to claim 18, wherein said rotation limiting means comprises a protrusion in one of said lids and a guide recess on the other of said lids, the protrusion interfitting within said guide recess, the apertures being in registry when the protrusion is at one end of the recess and being out of overlapping relationship when at the opposite end of the guide recess.

20. A top according to claim 19, wherein said guide recess is an arcuate groove.

21. A top according to claim 20, wherein said protrusion is in said first lid and said arcuate groove is on said second lid.

22. A top according to claim 15, further including means for establishing a seal in surrounding relationship to the weakened region on said first lid when said first and second lids are in said first position.

23. A top according to claim 22, wherein said sealing means comprises a sealing surface portion immediately surrounding the aperture of said first lid and a sealing surface portion on said second lid, said sealing surface portions coming into contact to effect the sealing means when said second lid is rotated relative to said first lid such that the aperture in said second lid is displaced from the aperture in said first lid.

24. A top according to claim 23, further including means for limiting the rotation of the second lid relative to the first lid, said rotation limiting means permitting relative rotation between a first position in which said apertures are in registry and a second position in which said sealing surface portions are in registry.

25. A top according to claim 24, wherein said rotation limiting means comprises a protrusion on one of said lids and a guide recess on the other of said lids, the protrusion interfitting within said guide recess, the apertures being in registry when the protrusion is at one end of the recess and the sealing surfaces being in registry when the protrusion is at the opposite end of the guide recess.

26. A top according to claim 25, wherein said guide recess is an arcuate groove.

27. A top according to claim 26, wherein said protrusion is on said first lid and said groove is on said second lid.

28. A top according to claim 15, wherein said fracture zone comprises a score line.

29. A top according to claim 28, wherein said score line completely surrounds said raised surface portion.

30. A top according to claim 29, wherein said score line is deepest on the side of said first raised surface portion which is interengageable upon relative rotation of said lids from said first position, the portion of the score line remote from the deepest portion being relatively shallow and serving as a hinge for the raised surface portion when the surface portions interengage to effect fracture along said score line.

31. A beverage container comprising side walls, a bottom and a top, said top comprising a first lid joined to the side walls, said first lid being substantially planar and having a raised surface portion disposed thereon, a groove surrounding said raised surface portion and a second lid, said second lid being substantially planar and being movably mounted on the top of the first lid for relative motion with respect to said first lid, said second lid having a second raised surface portion interengageable with the raised surface portion of the first lid upon relative rotation of the second lid with respect to the first, said second lid having an aperture adjacent to said second raised surface portion, said aperture being angularly displaced from the groove in the first lid, said second raised surface portion being positioned to interengage and fracture the raised surface portion of said first lid at said groove to form an aperture upon motion of the second lid relative to the first, said aperture in said second lid being positioned to provide the aperture in the first lid a pour aperture for the beverage upon further motion of the second lid relative to the first.

32. A beverage container according to claim 31, wherein said groove has a relative shallow portion disposed oppositely to the point where said surface portions of said lids interengage, said relatively shallow portion being bendable and serving as a hinge for said raised surface portion when said aperture is formed.

33. A container according to claim 32, further including means for limiting the motion of the second lid relative to the first lid, said motion limiting means permitting relative motion between a first position in which said apertures are displaced and a second position in which said apertures are in registry.

34. A container according to claim 32, wherein said motion limiting means comprises a protrusion in one of said lids and a guide recess on the other of said lids, the protrusion interfitting within said guide recess, the apertures being in registry when the protrusion is at one end of the recess and being out of registry when at the opposite end of the guide recess.

35. A container according to claim 34, wherein said guide recess is a groove.

36. A container according to claim 35, wherein said protrusion is in said first lid and said groove is on said second lid.

37. A container according to claim 35, wherein said protrusion is in said second lid and said groove is on said first lid.

38. A container according to claim 37, further including sealing means comprising a sealing surface portion immediately surrounding the aperture of said first lid and a sealing surface portion on said second lid, said sealing surface portions coming into contact to effect the sealing means when said second lid is moved relative to said first lid such that the aperture in said second lid is displaced from the aperture in said first lid.

39. A container according to claim 38, further including means for limiting the motion of the second lid relative to the first lid, said rotation limiting means permitting relative motion between a first position in which said apertures are in registry to a second position in which said sealing surface portions are in registry.

40. A container according to claim 39, wherein said motion limiting means comprises a protrusion in one of said lids and a guide recess on the other of said lids, the protrusion interfitting within said guide recess, the apertures being in registry when the protrusion is at one end of the recess and the sealing surfaces being in registry when the protrusion is at the opposite end of the guide recess.

41. A container according to claim 40, wherein said guide recess is a groove.

42. A container according to claim 41, wherein said protrusion is on said first lid and said groove is on said second lid.

* * * * *